United States Patent [19]

Tsuruoka et al.

[11] Patent Number: 5,021,834

[45] Date of Patent: Jun. 4, 1991

[54] WET-TYPE IMAGE FORMATION APPARATUS

[75] Inventors: Ichirio Tsuruoka, Tokyo; Katsuhiro Echigo; Manabu Mochizuki, both of Yokohama; Tsuneo Kurotori, Tokyo; Kenzo Ariyama, Yokohama; Kenji Kojima; Mayumi Miyao, both of Tokyo, all of Japan

[73] Assignee: Ricoh Company, Ltd., Tokyo, Japan

[21] Appl. No.: 583,441

[22] Filed: Sep. 17, 1990

[30] Foreign Application Priority Data

Sep. 20, 1989 [JP] Japan ..... 1-244693

[51] Int. Cl.[5] ..... G03G 15/10

[52] U.S. Cl. ..... 355/256; 355/296

[58] Field of Search ..... 355/256, 297, 296, 298, 355/299; 430/111, 116, 117, 115; 354/318, 322, 321; 222/371, 415; 204/202, 203

[56] References Cited

U.S. PATENT DOCUMENTS 3,915,874 10/1975 Machida ..... 430/111
4,230,406 10/1980 Klett ..... 355/298 X
4,306,009 12/1981 Veillette et al. ..... 430/115
4,356,098 10/1982 Chagnon ..... 252/62.51
4,840,865 6/1989 Kato et al. ..... 430/115
4,905,047 2/1990 Ariyama ..... 355/256
4,963,944 10/1990 Tange ..... 355/298
4,974,027 11/1990 Landa et al. ..... 355/256

*Primary Examiner*—A. T. Grimley
*Assistant Examiner*—Sandra L. Hoffman
*Attorney, Agent, or Firm*—Cooper & Dunham

[57] ABSTRACT

A wet-type image formation apparatus comprising (i) a belt-shaped photoconductor prepared by depositing a photoconductive material on the outer surface of a belt-shaped substrate; (ii) a plurality of pulleys which support and drive the belt-shaped photoconductor; (iii) a charging unit; (iv) an exposure unit; (v) a development unit; (vi) an image transfer unit; (vii) a squeeze roller unit, comprising a pair of roller-supporting members and a co-axial roller; (viii) a cleaning means; (ix) a liquid developer removing unit which is provided inside the belt-shaped photoconductor, capable of removing the liquid developer dropping onto the inner surface of the belt-shaped photoconductor and recovering it in a liquid developer reservoir or a development unit.

8 Claims, 3 Drawing Sheets

WET-TYPE IMAGE FORMATION APPARATUS

BACKGROUND OF THE INVENTION

1. Field of the Invention

The present invention relates to an image formation apparatus employing an electrostatic recording method, and in particular to a wet-type image formation apparatus equipped with belt-shaped photoconductor.

2. Discussion of Background

In an image formation apparatus employing an electrostatic recording method, such as a plain paper copier (PPC), a powdered developer is generally used for developing a latent electrostatic image into a visible toner image.

A liquid-type developer is also conventionally used in this kind of image formation apparatus. This wet development process is superior to the above-mentioned dry-type development process in the image quality of the obtained images because of the difference in the diameter of the particles constituting the developer. The wet development process, however, has a shortcoming inasmuch as the handling of the image formation apparatus is troublesome.

To achieve the image formation in this kind of image formation apparatus a drum-shaped photoconductor is usually used. In the case where the drum-shaped photoconductor is employed, however, the focus on the outer surface of the drum-shaped photoconductor may deviate when the drum-shaped photoconductor is exposed to light images which are converted from original images by an optical scanning system. In addition, flash exposure cannot be used, so that the high-speed image formation cannot be obtained. Furthermore, compact image formation apparatus equipped with a drum-shaped photoconductor is difficult to fabricate.

To solve the above-mentioned problems, a belt-shaped instead of a drum-shaped photoconductor has been used in a dry-type image formation apparatus.

However, the aforementioned belt-shaped photoconductor cannot be employed in the wet-type image formation apparatus because of various problems caused by the use of the liquid developer. For example, the belt-shaped photoconductor slips from the pulleys because the liquid developer flows into the gap between each pulley and the belt-shaped photoconductor. In addition to the above, the liquid developer drops onto the image transfer unit along the inner surface of the belt-shaped photoconductor, and the transfer sheet is therefore stained with the liquid developer in the image transfer unit. This problem frequently occurs when the carrier liquid for the liquid developer contains silicone oil which evaporates relatively slowly.

Furthermore, toner particles contained in the liquid developer are deposited in the areas around the belt-shaped photoconductor if the image forming operation is discontinued for a long time, because the carrier liquid for the liquid developer readily evaporates. For these reasons, the belt-shaped photoconductor is conventionally used only in the dry-type image formation apparatus.

SUMMARY OF THE INVENTION

Accordingly, an object of the present invention is to provide a wet-type image formation apparatus equipped with a belt-shaped photoconductor, free from the above-mentioned problems, capable of yielding excellent images at high speed.

Another object of this invention is to provide a compact wet-type image formation apparatus.

The above-mentioned objects of the present invention can be achieved by a wet-type image formation apparatus comprising (i) a belt-shaped photoconductor prepared by depositing a photoconductive material on the outer surface of a belt-shaped substrate; (ii) a plurality of pulleys which support and drive the above-mentioned belt-shaped photoconductor; (iii) a charging means capable of imparting an electric charge to the belt-shaped photoconductor; (iv) an exposure means capable of exposing the belt-shaped photoconductor to light images; (v) a development means which is directed to the outer surface of the belt-shaped photoconductor, and is capable of developing a latent electrostatic image into a visible toner image with a liquid developer; (vi) an image transfer means capable of transferring the visible toner image from the belt-shaped photoconductor to a transfer sheet; (vii) a squeeze roller unit positioned between the development means and the image transfer means, comprising (a) a pair of roller-supporting members in contact with the non-image areas at the opposite sides of the belt-shaped photoconductor, and (b) a co-axial roller for which the outer diameter is smaller than that of the above-mentioned roller-supporting member, directed to the image areas on the photoconductor with a slight gap between the co-axial roller and the belt-shaped photoconductor; (viii) a cleaning means positioned downstream of the image transfer means along the belt-shaped photoconductor, which comprises a cleaning member in contact with the surface of the belt-shaped photoconductor; and (ix) a liquid developer removing means which is provided inside the belt-shaped photoconductor, capable of removing the liquid developer dropping onto the inner surface of the belt-shaped photoconductor therefrom and recovering it in a liquid developer reservoir or a development unit.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

According to the present invention, latent electrostatic images formed on a belt-shaped photoconductor are developed to visible toner images with a liquid-type developer, so that the image quality of the obtained images is improved.

The belt-shaped photoconductor has a high degree of freedom in its arrangement in the apparatus, which can minimize the size of the apparatus. In addition to the above, since the surface of the photoconductor which is exposed to the light images is a plane, the light images are always projected in focus onto the surface of the photoconductor.

Furthermore, flash exposure can be used when the belt-shaped photoconductor is employed in the image formation apparatus. This will increase the image forming speed.

Figure 1:
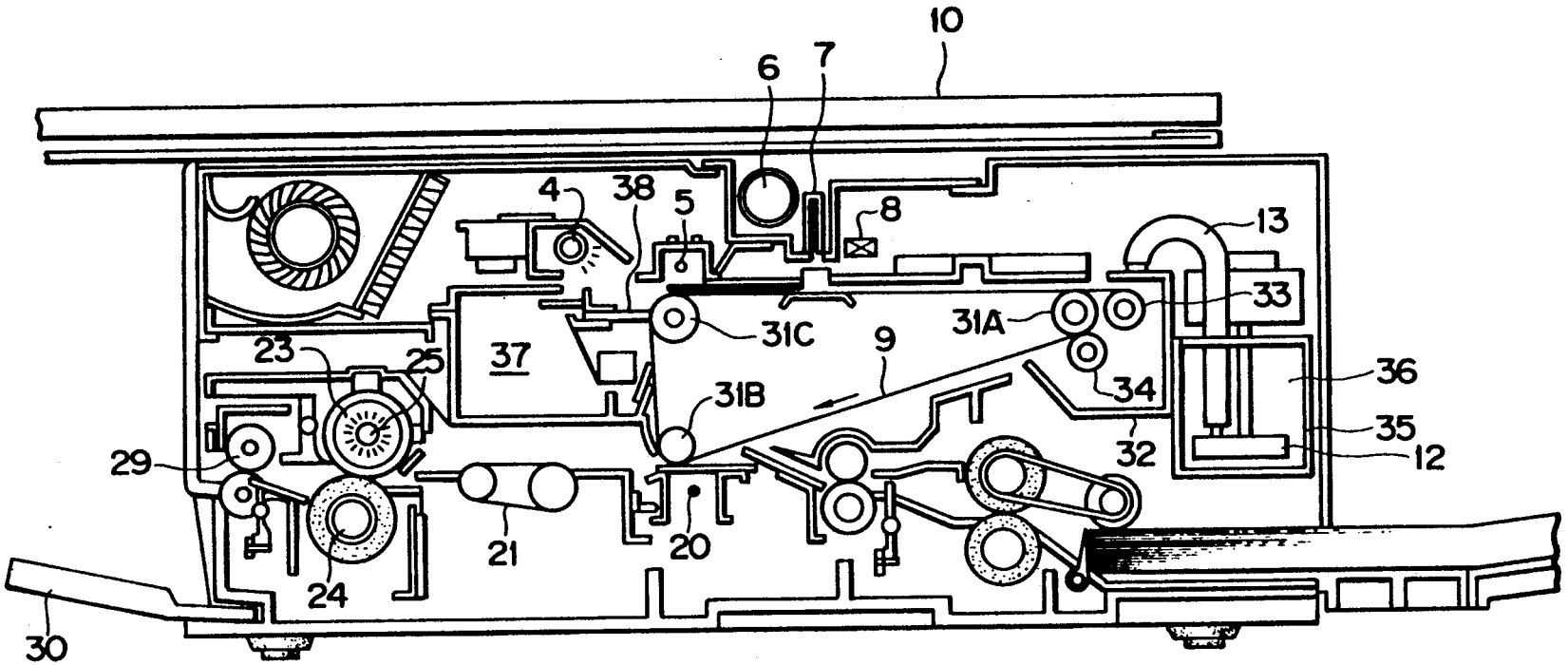
FIG. 1 is a schematic front view of an example of a wet-type image formation apparatus according to the present invention.

FIG. 1 is a schematic view of the mechanism in a wet-type electrophotographic copier, one example of the wet-type image formation apparatus according to the present invention.

An original table 10 is provided at the upper part of the wet-type electrophotographic copier as shown in FIG. 1. An original (not shown) is placed between a transparent contact glass and the original table 10, with an image-bearing surface thereof turned to the contact glass. As the original table 10 reciprocates right and left, the image-bearing surface of the original is exposed to an exposure lamp 6 through the contact glass and original images are sequentially read by scanning. The light reflected by the original is passed through a plurality of optical fibers 7, and finally, an image is formed on the surface of a belt-shaped photoconductor 9 which is provided below the optical fibers 7.

The belt-shaped photoconductor 9 is supported by a drive pulley 31A, a tensioner 31B and a follower pulley 31C positioned inside thereof, and is rotatably driven in the direction of the arrow through the predetermined path.

A main charger 5, a plurality of optical fibers 7, a belt-seam sensor 8, a development roller 33, a squeeze roller unit 34, a transfer charger 20, a cleaning unit 37 and a quenching lamp 4 are sequentially provided along the outer surface of the belt-shaped photoconductor 9.

The image formation is carried out in such a manner that the outer surface of the belt-shaped photoconductor 9 is uniformly charged to a predetermined polarity by the main charger 5, and exposed to light images which are transmitted through the optical fibers 7. Latent electrostatic images corresponding to the light images are formed on the surface of the belt-shaped photoconductor 9.

As the belt-shaped photoconductor 9 rotates, the latent electrostatic images formed on the belt-shaped photoconductor 9 reach the development roller 33. A liquid developer 36 is applied to the latent electrostatic images by the development roller 33 and toner particles contained in the liquid developer 36 are electrostatically attracted to the latent electrostatic images on the photoconductor 9 in accordance with the distribution of electric potential on the photoconductor 9. Thus, latent electrostatic images are developed to visible toner images.

A sheet of transfer paper is sent to the belt-shaped photoconductor 9 by a paper supply unit synchronously with the formation of the visible toner images on the belt-shaped photoconductor 9. The transfer sheet is moved along the belt-shaped photoconductor 9, overlapping the visible toner images formed thereon. When the transfer sheet passes the transfer charger 20, the toner images developed on the belt-shaped photoconductor 9 are transferred to the transfer sheet via the transfer charger 20. The transfer sheet which bears the toner images is separated from the belt-shaped photoconductor 9 and led to an image fixing unit along a transport belt 21.

In the image fixing unit, the toner images transferred to the transfer sheet are fixed thereto by passing between a pressure-application roller 24 and a heat-application roller 23 with a built-in heater 25. The transfer sheet is then discharged to a paper discharge tray 30 through a set of paper discharging rollers 29.

In the electrophotographic copier as shown in FIG. 1, a liquid-type developer is used. A liquid developer 36 stored in a liquid developer reservoir 35 is pumped by a pump 12 through a developer supply pipe 13 and supplied to a development unit 32. The liquid developer 36 is applied to the belt-shaped photoconductor 9 by the development roller 33.

The squeeze roller unit 34 is positioned downstream from the development roller 33. The squeeze roller unit comprises a pair of roller-supporting members which is in contact with the opposite sides (non-image areas) of the belt-shaped photoconductor 9, and a co-axial roller for which the outer diameter is slightly smaller than that of the above roller-supporting member.

The co-axial roller of the squeeze roller unit 34 is positioned with a slight gap (100 to 300 $\mu$m) between the co-axial roller and the belt-shaped photoconductor 9, and is rotatably driven in the direction opposite to the rotating direction of the belt-shaped photoconductor 9 at the contact surface thereof. In FIG. 1, the squeeze roller unit 34 is rotatably driven in the clockwise direction. The squeeze roller unit 34 serves to scrape an excess of the liquid developer off the surface of the belt-shaped photoconductor 9 by hydrodynamic action. The excessive liquid developer on the belt-shaped photoconductor 9 is thus removed therefrom by the squeeze roller unit 34 and collected in the bottom of the development unit 32 together with the unused liquid developer. This liquid developer finally returns to the liquid developer reservoir 35 and is repeatedly used.

In the cleaning unit 37, a blade 38 is provided, with one end portion thereof coming in contact with the surface of the belt-shaped photoconductor 9. The blade 38 serves to scrape the residual liquid developer from the belt-shaped photoconductor 9 after the image transfer. Instead of the blade 38, a sponge roller may be provided in contact with the surface of the belt-shaped photoconductor 9.

Figure 2A:
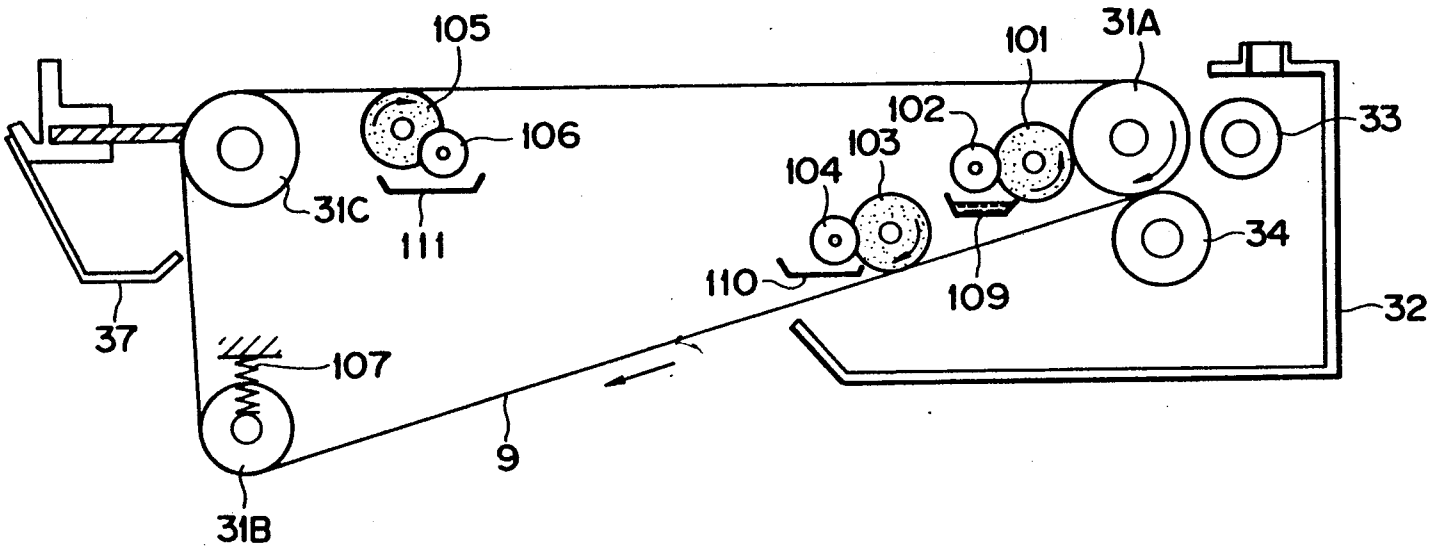
FIG. 2(*a*) and FIG. 2(*b*) are enlarged detailed views around the belt-shaped photoconductor in the wet-type image formation apparatus of FIG. 1, in explanation of the liquid developer removing means.
Figure 2B:
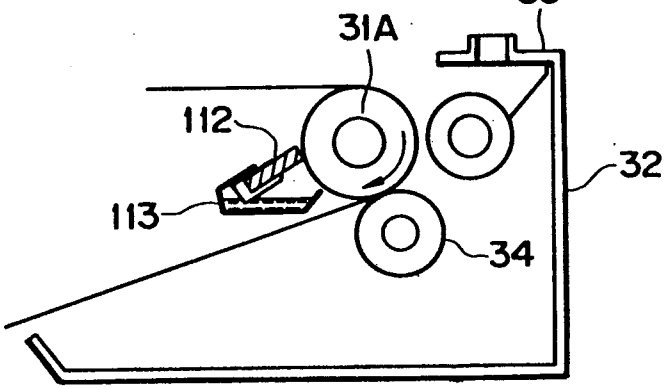

The liquid developer removing means for use in the present invention will now be explained in detail with reference to FIGS. 2(*a*), 2(*b*) and 3. In the present invention the liquid developer removing means is provided inside the belt-shaped photoconductor 9 as shown in FIG. 2(*a*) in order to prevent the belt-shaped photoconductor from slipping and the liquid developer from dropping onto the inner surface of the belt-shaped photoconductor and reaching the image transfer unit.

For instance, the liquid developer removing means is disposed at the following three positions:

(1) In contact with the drive pulley 31A

When the liquid developer which has been supplied to the development roller 33 is applied to the belt-shaped photoconductor 9, it may flow to the inside of the belt-shaped photoconductor 9 and wet the outer surface of the drive pulley 31A. As a result, the friction between the belt-shaped photoconductor 9 and the drive pulley 31A is decreased and the belt-shaped photoconductor 9 slips therefrom. Therefore, the liquid developer deposited on the drive pulley 31A is removed by the liquid developer removing means.

(2) In contact with the inner surface of the belt-shaped photoconductor 9 between the development unit 32 and the image transfer unit When the liquid developer flows to the inside of the belt-shaped photoconductor 9 and drops onto the inner surface of the belt-shaped photoconductor 9 to reach the image transfer unit, the transfer sheet may be stained with the liquid developer in the image transfer unit. Therefore, the liquid developer flowing to the inner surface of the belt-shaped photoconductor 9 is removed by the liquid developer removing means.

(3) In contact with the inner surface of the belt-shaped photoconductor 9 between the cleaning unit 37 and the drive pulley 31A

When the liquid developer in the cleaning unit flows to the inside of the belt-shaped photoconductor 9 and wets the follower pulley 31C, the belt-shaped photoconductor 9 may readily slip. Therefore the liquid developer flowing onto the inner surface of the belt-shaped photoconductor 9 is removed by the liquid developer removing means.

In the case where the liquid developer flows to the inside of the belt-shaped photoconductor 9 from other units than the development unit and the cleaning unit, the liquid developer removing means may be provided between the above-mentioned areas and the drive pulley 31A or the image transfer unit to effectively prevent the belt-shaped photoconductor 9 from slipping and the transfer sheet from being stained with the liquid developer.

When the liquid developer flows to the inside of the belt-shaped photoconductor 9 at the tensioner 31B or the follower pulley 31C, the liquid developer removing means may be provided between the position from which the liquid developer flows and the tensioner 31B or the follower pulley 31C.

In FIG. 2(*a*), the liquid developer removing means for use in the present invention comprises a liquid-developer-absorption roller 101 (103 and 105) which is made of an expanded material such as sponge, a squeeze roller 102 (104 and 106) and a liquid developer recovery tray 109 (110 and 111). Reference numeral 107 indicates a spring.

Figure 3:
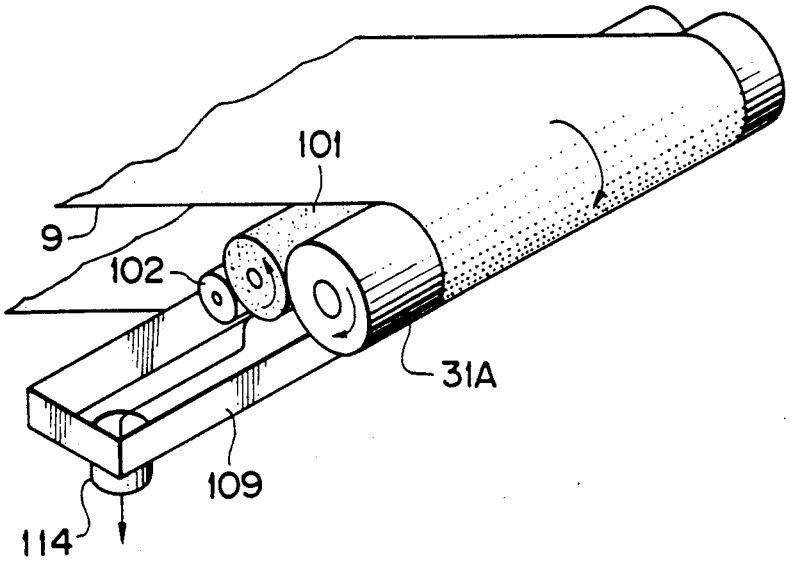
FIG. 3 is a perspective view around a drive pulley of the belt-shaped photoconductor in the wet-type image formation apparatus of FIG. 1, in explanation of the liquid developer removing means.

For example, as shown in FIG. 3, the liquid developer which flows from the development roller to the inner surface of the belt-shaped photoconductor 9 and wets the drive pulley 31A is absorbed by the liquid-developer-absorption roller 101 which is brought into contact with the drive pulley 31A. The liquid developer absorbed by the liquid-developer-absorption roller 101 is squeezed by the squeeze roller 102 which is rotatably brought into contact with the above liquid-developer-absorption roller 101. The liquid developer is then recovered in the liquid developer recovery tray 109. The liquid developer thus recovered in the liquid developer recovery traY 109 finally flows into a discharge hole 114 and returns to the liquid developer reservoir or the development unit.

Alternatively, the liquid developer removing means for use in the present invention comprises a cleaning blade 112 which is brought into contact with the surface of any pulley and a liquid developer recovery tray 113 as shown in FIG. 2(*b*).

When this kind of wet-type image formation apparatus as shown in FIG. 1 is allowed to stand for an extended period of time without performing the image forming operation, the belt-shaped photoconductor 9 becomes hard as the residual liquid developer evaporates, and the toner particles contained in the liquid developer are apt to be deposited on several parts around the belt-shaped photoconductor 9, for example, between the squeeze roller unit 34 and the belt-shaped photoconductor 9, between the blade 38 in the cleaning unit 37 and the photoconductor 9 and between the pulleys 31A, 31B and 31C, and the photoconductor 9. This results from the evaporation of a carrier liquid for the liquid developer. When the image forming operation is resumed with no attention paid to the above-mentioned toner deposition problems in the apparatus, a considerable stress is applied to the belt-shaped photoconductor 9, causing the photoconductor 9 to become creased, folded or broken.

To solve the above-mentioned problem, a carrier liquid for the liquid developer for use in the present invention comprises the following components:

(i) The carrier liquid for the liquid developer for use in the present invention comprises a silicone oil with a siloxane structure in a mixing ratio of at least 5 vol. %.

(ii) The carrier liquid for the liquid developer for use in the present invention comprises a plurality of petroleum aliphatic hydrocarbons, each with a different evaporation speed.

Since the carrier liquid for the liquid developer for use in the present invention comprises the silicone oil with the siloxane structure or the petroleum aliphatic hydrocarbon which evaporates relatively slowly, as previously mentioned, the rapid evaporation of the liquid developer can be prevented and toner particles are not left alone around the belt-shaped photoconductor 9. Accordingly, the toner deposition problem can be avoided.

However, the silicone oil with the siloxane structure or the petroleum aliphatic hydrocarbon, of which evaporation speed is relatively slow have high viscosities, so that when they are used alone as the carrier liquid, they have an adverse influence on the circulating mechanism of the liquid developer in the apparatus so that the image quality of the obtained images is degraded. Furthermore, the liquid developer comprising the silicone oil readily flows to the belt-shaped photoconductor, as previously mentioned. For these reasons, the silicone oil with the siloxane structure or the petroleum aliphatic hydrocarbon which evaporates relatively slowly is used together with the liquid component which evaporates relatively quickly.

A toner-deposition test was carried out using different kinds of liquid developers.

The liquid developers were separately prepared by dispersing 100 g of toner particles in 1 l of different kinds of carrier liquids as shown in Table 1. Each liquid developer was applied to the areas between the squeeze roller and the belt-shaped photoconductor 9, between the blade 38 in the cleaning unit 37 and the photoconductor 9 and between the pulleys and the photoconductor 9 in the wet-type image formation apparatus as shown in FIG. 1, and was allowed to stand at 25°±1° C. for 2 weeks. After 2 weeks, deposition of the toner particles at the above-mentioned areas was evaluated. The results are shown in Table 1.

TABLE 1

| Carrier Liquid (vol. %) | Boiling Point | Deposition of Toner Particles * |
|---|---|---|
| Isopar E ** (100) | 115.6 to 141.1 | X |
| Isopar G ** (100) | 159.0 to 176.7 | X |

TABLE 1-continued

| Carrier Liquid (vol. %) | Boiling Point | Deposition of Toner Particles * |
|---|---|---|
| Isopar H ** (100) | 176.7 to 183.3 | X |
| Isopar K ** (100) | 183.3 to 195.0 | X |
| Isopar L ** (100) | 188.9 to 207.8 | X |
| Isopar M ** (100) | 206.1 to 246.7 | Δ |
| Isopar V ** (100) | 255.0 to 301.0 | O |
| Polydimethyl siloxane (100) | — | O |
| Polymethylphenyl siloxane (100) | — | O |
| Isopar H/polydimethyl siloxane (95/5) | — | O |
| Isopar H/polydimethyl siloxane (90/10) | — | O |
| Isopar H/polydimethyl siloxane (75/25) | — | O |
| Isopar H/polymethyl-phenyl siloxane (95/5) | — | O |
| Isopar H/polymethyl-phenyl siloxane (90/10) | — | O |
| Isopar H/polymethyl-phenyl siloxane (75/25) | — | O |
| Isopar H/Isopar V (95/5) | — | O |
| Isopar H/Isopar V (90/10) | — | O |
| Isopar H/Isopar V (75/25) | — | O |

* X . . . Toner particles were deposited on all the surfaces in the areas to which the liquid developer was applied, and each part could not function.
O . . . No toner particles were deposited on the surfaces of the areas.
** commercially available from Exxon Chemical Japan Ltd.

As can be seen from the results in Table 1, when the carrier liquid for the liquid developer comprises silicone oil with a siloxane structure, namely polydimethyl siloxane or polymethylphenyl siloxane, the toner particles are not deposited in the areas to which the liquid developer has been applied. This is because the above-mentioned silicone oils do not readily evaporate. When the silicone oil with a siloxane structure and a petroleum aliphatic hydrocarbon such as Isopar H are used in combination as the carrier liquid, the silicone oil is retained in the liquid developer to prevent the toner particles from depositing on the various parts around the belt-shaped photoconductor even after the petroleum aliphatic hydrocarbon "Isopar H" is easily evaporated.

When the silicone oil with a siloxane structure is used alone as the carrier liquid for the liquid developer, satisfactory results can be obtained. However, the silicone oil is preferably mixed with the petroleum aliphatic hydrocarbon in practical use because the viscosity of the silicone oil is rather high.

In Table 1, the respective Isopars are seen to have different boiling points. The higher the boiling point of the Isopar, the higher the viscosity thereof. For example, "Isopar V" has a high boiling point and a high viscosity and evaporates relatively slowly. When "Isopar V" is used as the carrier liquid for the liquid developer, the liquid developer does not readily evaporate and toner particles can be prevented from depositing on the areas around the belt-shaped photoconductor even though the wet-type image formation apparatus is allowed to stand for an extended period of time without being used.

However, the petroleum aliphatic hydrocarbon with a high boiling point and high viscosity has a low fluidity. Therefore, when "Isopar V" is used alone as the carrier liquid for the liquid developer, normal operation cannot be ensured in the development unit, squeeze roller unit and cleaning unit. This will cause deterioration of the image quality.

To prevent the above-mentioned deterioration of the image quality, it is preferable that two kinds of petroleum aliphatic hydrocarbons, each with a different viscosity, that is, with different evaporation characteristics, be used together as the carrier liquid for the liquid developer. As shown in Table 1, when Isopar V is mixed with Isopar H at a mixing ratio of at least 5 vol. %, the toner deposition problem can be avoided.

As previously mentioned, a belt-shaped photoconductor can be employed in the wet-type image formation apparatus according to the present invention. As a result, the light images can always be projected in focus onto the plane surface of the photoconductor when the photoconductor is exposed to the light images. Furthermore, flash exposure can be used, which can increase the image formation speed.

In addition, since the liquid developer removing means is provided in the wet-type image formation apparatus according to the present invention, the belt-shaped photoconductor can smoothly be rotatably driven and the transfer sheet can be prevented from being stained with the liquid developer which flows from the development unit or the cleaning unit and drops onto the inner surface of the belt-shaped photoconductor to reach the image fixing unit.

Furthermore, since the carrier liquid for the liquid developer for use in the present invention comprises the silicone oil with a siloxane structure or the petroleum aliphatic hydrocarbon which evaporates relatively slowly, the rapid evaporation of the liquid developer can be prevented and toner particles are not left around the belt-shaped photoconductor. Accordingly, the toner deposition problem can be avoided.

What is claimed is:

1. A wet-type image formation apparatus comprising (i) a belt-shaped photoconductor prepared by depositing a photoconductive material on the outer surface of a belt-shaped substrate; (ii) a plurality of pulleys which support and drive said belt-shaped photoconductor; (iii) a charging means capable of imparting an electric charge to said belt-shaped photoconductor; (iv) an exposure means capable of exposing said belt-shaped photoconductor to light images; (v) a development means which is directed to the outer surface of said belt-shaped photoconductor, and is capable of developing a latent electrostatic image into a visible toner image with a liquid developer; (vi) an image transfer means capable of transferring said visible toner image from said belt-shaped photoconductor to a transfer sheet; (vii) a squeeze roller unit positioned between said development means and said image transfer means, comprising (a) a pair of roller-supporting members, in contact with the non-image areas at the opposite sides of said belt-shaped photoconductor and (b) a co-axial roller for which the outer diameter is smaller than that of said roller-supporting member, directed to image areas of said photoconductor with a slight gap between said co-axial roller and said belt-shaped photoconductor; (viii) a cleaning means positioned downstream of said image transfer means along said belt-shaped photoconductor, which comprises a cleaning member in contact with the surface of said belt-shaped photoconductor; and (ix) a liquid developer removing means which is provided inside said belt-shaped photoconductor, capable of removing said liquid developer dropping onto the inner surface of said belt-shaped photoconductor and recovering said liquid developer in a liquid developer reservoir or a development unit.

2. The wet-type image formation apparatus as claimed in claim 1, wherein said cleaning member is a blade.

3. The wet-type image formation apparatus as claimed in claim 1, wherein said cleaning member is a sponge roller.

4. The wet-type image formation apparatus as claimed in claim 1, wherein said liquid developer comprises a carrier liquid which comprises a silicone oil with a siloxane structure in a mixing ratio of at least 5 vol. %.

5. The wet-type image formation apparatus as claimed in claim 1, wherein said liquid developer comprises a carrier liquid which comprises a plurality of petroleum aliphatic hydrocarbons, each with a different rate of evaporation.

6. The wet-type image formation apparatus as claimed in claim 1, wherein said liquid developer removing means comprises a liquid-developer-absorption roller which is in contact with the inner surface of said belt-shaped photoconductor, a squeeze roller in contact with said liquid-developer-absorption roller, and a liquid developer recovery tray for recovering said liquid developer.

7. The wet-type image formation apparatus as claimed in claim 1, wherein said liquid developer removing means comprises a liquid-developer-absorption roller which is in contact with at least one of said pulleys which support said belt-shaped photoconductor, a squeeze roller in contact with said liquid-developer-absorption roller, and a liquid developer recovery tray for recovering said liquid developer.

8. The wet-type image formation apparatus as claimed in claim 1, wherein said liquid developer removing means comprises a cleaning blade which is in contact with at least one of said pulleys which support said belt-shaped photoconductor, and a liquid developer recovery tray for recovering said liquid developer.

* * * * *